US006079731A

United States Patent [19]

Emig et al.

[11] Patent Number: 6,079,731

[45] Date of Patent: Jun. 27, 2000

[54] BINDING SUPPORTING PLATE FOR A SKI

[76] Inventors: Uwe Emig, Gartenstrasse 29, D-69429 Waldbrunn; Reinhold Geilsdoerfer, Landsehrstrasse 35, D-74821 Mosbach; Markus Gramlich, Alte Dielbacher Strasse 29, D-69412 Eberbach, all of Germany

[21] Appl. No.: 09/147,517

[22] PCT Filed: Jul. 19, 1997

[86] PCT No.: PCT/DE97/01519

§ 371 Date: Jan. 13, 1999

§ 102(e) Date: Jan. 13, 1999

[87] PCT Pub. No.: WO98/04324

PCT Pub. Date: Feb. 5, 1998

[30] Foreign Application Priority Data

Jul. 28, 1996 [DE] Germany ..... 196 30 367

[51] Int. Cl.[7] ..... A63C 9/085

[52] U.S. Cl. ..... 280/607; 280/618

[58] Field of Search ..... 280/601, 607, 280/609, 617, 618, 626, 611

[56] References Cited

U.S. PATENT DOCUMENTS 4,974,867 12/1990 Rullier et al. .

5,538,271 7/1996 Abondance .

FOREIGN PATENT DOCUMENTS 296 03 405 8/1996 Germany .

*Primary Examiner*—Richard M. Camby

*Attorney, Agent, or Firm*—Arent Fox Kintner Plotkin & Kahn, PLLC

[57] ABSTRACT

In a binding support plate (1) having a base plate (2) on the side close to the top side of a ski (6) and securable thereto and a bearing plate (3) which is arranged between the base plate (2) and the binding or shoe sole, an intermediate plate (4) made of an elastomeric material is arranged between the base plate (2) and the bearing plate (3), being elastically deformable by the forces occurring between the ski (6) and the shoe during skiing. The bearing plate (3) is movable, by deformation of the intermediate plate (4), relative to the base plate (2) in a direction transverse to the longitudinal direction of the ski (6) and is adapted to take support on the base plate (2) by means of guide elements. The movement of the bearing plate (3) in a direction transverse to the longitudinal direction of the ski (6) is limited by the guide elements to a variable degree dependent on the elastic deformation of the intermediate plate (4).

18 Claims, 5 Drawing Sheets

BINDING SUPPORTING PLATE FOR A SKI

This invention relates to a binding support plate of multiple element construction for a ski, having a base plate on the side close to the top side of the ski and securable thereto and a bearing plate which is arranged between the base plate and the binding or shoe sole and to which the binding can be secured.

Binding support plates are used for improving the transmission of forces between the shoe, the binding and the ski. They are intended furthermore to raise the position of the shoe on the ski, thereby increasing the edge pressure when the ski runs on the edge and making it easier to execute swings. In addition, binding support plates are expected to assist the damping of vibrations by making use of intermediate layers and support surfaces made of rubber elastic material.

In a known binding support plate of the type initially referred to, the base plate is comprised of a shell enveloping a cavity filled with rubber. On the underside of the base plate the shell has several openings through which the rubber material projects slightly to form a bearing surface. Arranged on the base plate is a bearing plate comprised of two fixed end plates with fastening holes for the binding elements and an interposed flexible plate which is held by the end plates and forms the support surface for the shoe. To fasten this known binding support plate the end plates are secured to the ski with screws which penetrate bores in the base plate.

With the known binding support plates the position of the binding and the shoe relative to the ski is fixed and cannot be changed. The only way to influence the running characteristics is by means of the overall height of the binding support plate and the attendant shift of the point of force application when the ski runs on the edge.

By contrast, it is an object of the present invention to provide a binding support plate of the type initially referred to which enables the ski's running characteristics to be improved by a controllable lateral shift of the point at which the force is transmitted between the shoe and the ski, independently of the overall height, and which is capable of effectively damping ski vibrations and shocks from the slope.

This object is accomplished by the present invention in that an intermediate plate made of an elastomeric material is arranged between the base plate and the bearing plate, being elastically deformable by the forces occurring between the ski and the shoe during skiing, and in that the bearing plate is movable, by deformation of the intermediate plate, relative to the base plate in a direction transverse to the longitudinal direction of the ski and is adapted to take support on the base plate by means of guide elements which limit the movement of the bearing plate in a direction transverse to the ski's longitudinal direction to a variable degree dependent on the elastic deformation of the intermediate plate.

With the binding support plate of the present invention, the bearing plate and binding and the shoe held by the binding are movable relative to the base plate and the ski in a direction transverse to the running direction of the ski. Hence it is possible for the center of force transmission to be shifted from the middle of the ski to the one or other side. This shift is controlled by the interaction of the elastomeric intermediate plate and the guide elements and is restricted to those running conditions when the ski is caused to run on the edge in order to achieve an increased edge pressure. Under normal loading when the ski has its running surface in full engagement with the slope, the bearing plate is centered by the elastomeric intermediate plate and the guide elements relative to the base plate and is stabilized in this position.

The binding support plate of the present invention has numerous advantages. Running characteristics are improved over those of the state of the art by a more favorable relationship between the bending angle of the skier's knee and the tilting angle of the ski edge. Steering response becomes more exact and the contact times of the ski's steering zones during running on the edge are shortened. The ski's tendency to slip sideways during running on the edge on steep terrain, on hard ground or during extremely tight swings is greatly reduced. It is possible furthermore to achieve higher turning speeds on extended swings, the skis running on a wider section of their surface at a flatter angle of tilt. Acceleration when coming out of a turn is increased. A further important characteristic of the binding support plate of the present invention is that the transmission of shocks and vibrations from the ski to the shoe is greatly dampened and the ski's vibrations are reduced by the elastomeric intermediate plate, thus enabling tireless skiing with less strain on the skier's joints. The magnitude of the load-dependent shift of standing position can be varied over a wide range by varying the elasticity of the intermediate plate and the guide elements while the overall height of the binding support plate is maintained at a uniform level. Thanks to its characteristics, the binding support plate of the present invention simulates a larger overall height than its actual overall height, thus enabling its overall height to be kept relatively small, which in turn results in weight savings and makes it easier for the skier to accustom.

Particularly advantageous is an embodiment of the binding support plate of the present invention in which the guide elements are comprised of two groups of tension members which penetrate the intermediate plate and have one of their ends anchored to the base plate and their other end to the bearing plate, wherein, looking in longitudinal direction, the tension members of the one group connect the left-hand side of the base plate with the right-hand side of the bearing plate while the tension members of the other group connect the right-hand side of the base plate with the left-hand side of the bearing plate. The described arrangement of the tension members ensures a stable center position of the bearing plate, the tension members also absorbing torsional forces around a vertical axis. The desirable lateral shifting of the bearing plate relative to the base plate is only possible by compressing the elastomeric intermediate plate, with the respective group of tension members limiting the path of deformation and ensuring the parallel alignment of the bearing plate relative to the longitudinal axis of the ski. A further effect produced by the tension members is to consolidate the transmission of force, which is important for the steering response. According to the present invention the tension members may be comprised of individual strips, bands or lamellae having their respective ends anchored in the base plate and the bearing plate, respectively. Particularly advantageous is an embodiment in which several tension members are comprised of a continuous length of band, strip, rope, wire or the like. In this way it is possible to greatly simplify the incorporation of the tension members during the production of the binding support plate. As material for the tension members a braided, woven or twisted high-strength fiber material, for example, made of carbon fibers, glass fibers, plastic fibers or metal yarns may be contemplated. The ends of the tension members can be fastened in simple manner by casting them integrally in the base plate and the bearing plate. If such a production method is impracticable for material reasons, for example, it is possible in accordance with a further proposal of the invention to embed the ends of the tension members in respective grooves in the base plate and bearing plate, which grooves are open on the side close to the intermediate plate, and to fix the ends of the tension members in place by filling the grooves with a suitable casting material such as the same material used for the intermediate plate. To protect the fixing ends and connectors of the tension members it is possible for the base plate and the bearing plate to be equipped on the outside with respective longitudinal grooves into which the through bores lead.

A further advantageous possibility of fixing the ends of the tension members provides for the base plate and the bearing plate to have through bores through which the tension members are passed, and the ends of the tension members projecting out of the bores are fixed to the respective plate. In this arrangement it is particularly advantageous if a length of band, strip, rope or wire for forming the tension members is passed along a meandering path through the through bores. With this embodiment it is also possible to tension the individual tension members before fixing their ends and hence to bias the elastomeric intermediate plate.

If the tension members are comprised of a rigid element such as a pin, a sheet-metal strip or the like, which is unable to give way or yield by bending when the distance between its fixing ends is reduced, the ends of the tension members have to be fastened in such a way as to permit the transmission of only tensile loads while a displacement relative to the respective plate is possible in the presence of compressive loads.

According to a further proposal of the present invention the underside of the bearing plate on its side close to the intermediate plate may be provided with a guide element formed by a pin, a rib or the like and rigidly connected to the bearing plate, which guide element projects with its free end into a recess in the base plate, in which it is movable vertically to the plane of the plate and adapted for swiveling motion around a center axis extending in the longitudinal direction of the plate. With this embodiment of the binding support plate, one or more guide elements arranged in the central plane vertical to the individual plates operate to stabilize the bearing plate in its position relative to the base plate and to predetermine a defined swivel movement of the bearing plate around the axis of the guide elements, thereby achieving the desired relationship of dependence between the bearing plate's lateral shift and the loading of the elastically deformable intermediate plate during running on the edge.

On the one hand, the axis of the swivel bearing may be formed by providing the free end of the guide element with a thick zone with contact surfaces of ball, cylinder or blade shape supported with practically zero play on parallel side walls of the recess in the base plate. On the other hand, the swivel bearing can also be constructed so that between the walls of the recess in the base plate and the free end of the guide element there is a clearance space on all sides filled with an elastomeric material, particularly the same material used for the intermediate plate. In this case it can be expedient, furthermore, for the guide element to have the shape of a cone or a triangular prism projecting with its point or edge into a mating recess in the base plate. To limit the swivel movement of the bearing plate to a maximum value, the base plate may be equipped with fixed stops on which the bearing plate or the guide element may take support.

The individual plates of the binding support plate of the present invention may have a rectangular cross section. Alternatively, however, it is also possible to provide for the contact surfaces on the base plate and the bearing plate on the side close to the intermediate plate to be curved around an axis extending in the longitudinal direction of the plates, with the contact surface of the base plate being convex while the contact surface of the bearing plate is concave. This construction of the binding support plate is advantageous particularly in connection with tension members in crosswise arrangement and promotes the lateral shift of the bearing plate during running on the edge.

To prevent the flexing line of the ski being affected by the binding support plate, it is possible in accordance with a further proposal of the present invention for the base plate to be comprised of two relatively movable parts lying one behind the other in the longitudinal direction. If the base plate is constructed as a single piece, a pivot-type suspension of the base plate known in the art can also be used to prevent the flexing line of the ski being affected.

Embodiments of the present invention will be described in more detail in the following with reference to the accompanying drawings. In the drawings, FIG. 1 is a side view of a binding support plate of the present invention as mounted on a ski;

Figure 1:
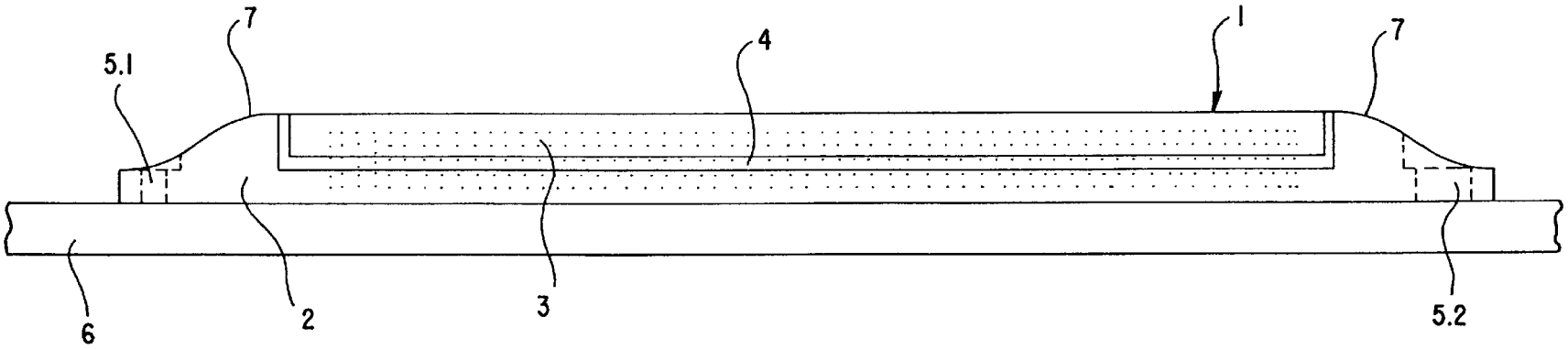

The binding support plate 1 shown in FIG. 1 is illustrated by way of example for all further embodiments shown only as fragments or as sections. It is comprised of a base plate 2, a bearing plate 3 and an intermediate plate 4 arranged between the base plate 2 and the bearing plate 3. The base plate 2 has its ends fastened to a ski 6 by means of a threaded joint 5.1 and a threaded joint 5.2 using an elongated hole. The bearing plate 3 and the intermediate plate 4 are shorter than the base plate 2, each having their respective ends enclosed by a hump 7 formed by the base plate 2 so that they are held on the base plate 2 in longitudinal direction. Between each of the humps 7 and the bearing plate 3 is a gap filled with a rubber elastic material. The base plate 2 and the bearing plate 3 are made of a strong plastic material which can be reinforced with fibers for increased strength. Instead of plastic it is possible to use a light metal material to manufacture the plates. The intermediate plate 4 is made of an elastomeric material, for example rubber, a thermoplastic polyester elastomer or the like. The ski binding, not shown, is fastened to the bearing plate 3 which is equipped for this purpose with a series of tapped holes.

Figure 3:
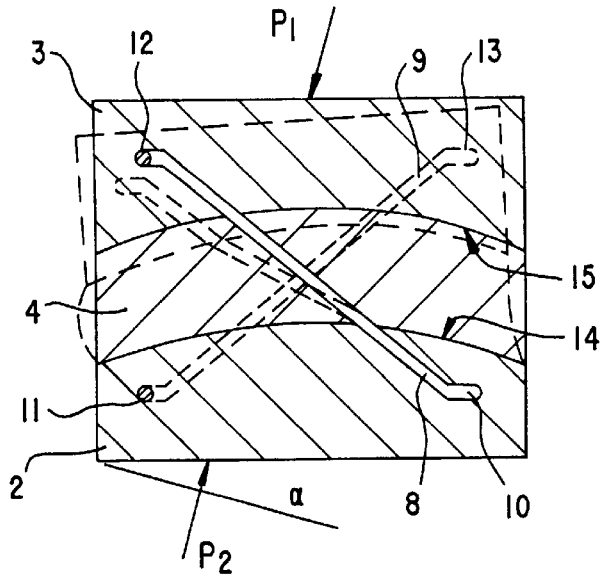
FIG. 3 is a cross sectional view of the binding support plate of FIG. 2, taken along the line III—III of that Figure.
Figure 2:
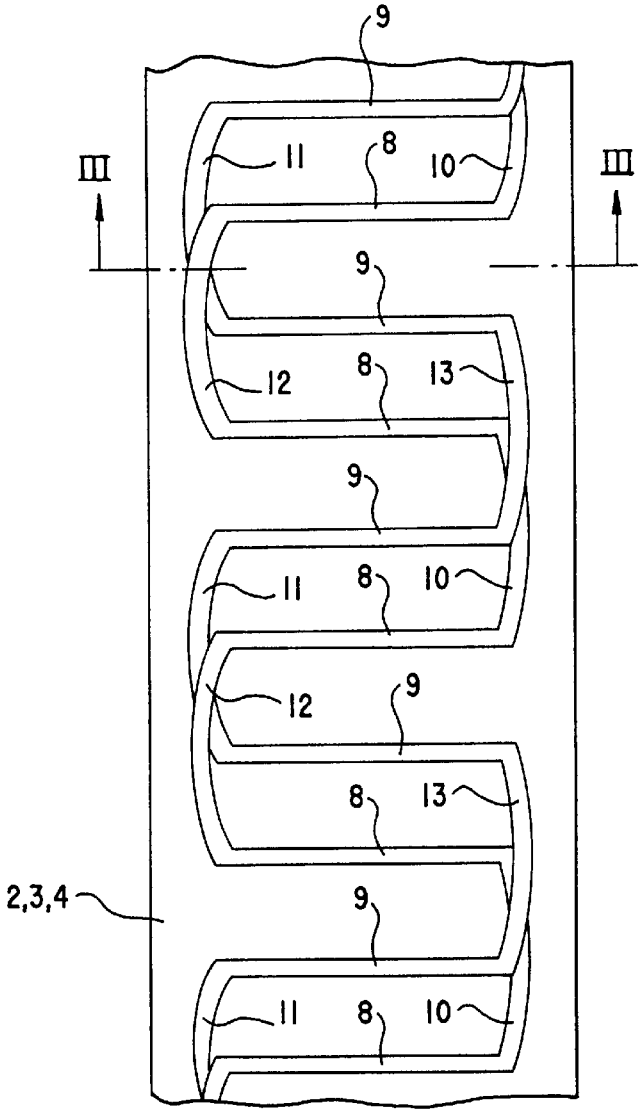
FIG. 2 is a top plan view, in a transparent representation, of a binding support plate having integrally cast tension members.

In the embodiment of the binding support plate shown in FIGS. 2 and 3, the base plate 2 is connected to the bearing plate 3 by two groups of tension members 8, 9 arranged cross-wise. Each group of tension members 8 and 9 is formed by a rope following a meandering course in an essentially diagonal plane of the binding support plate so that each two neighboring tension members 8 and 9 are joined together at one end by a connector 10, 12 and 11, 13, respectively. The connectors 10 between the tension members 8 and the connectors 11 between the tension members 9 extend inside the base plate 2. The connectors 12 of the tension members 8 and the connectors 13 of the tension members 9 extend inside the bearing plate 3.

The contact surface 14 of the base plate 2 on the side close to the intermediate plate 4 is of convex cylindrical shape, while the contact surface 15 of the bearing plate 3 on the side close to the intermediate plate 4 is of concave cylindrical shape, with the respective axis of curvature lying in the longitudinal center plane common to the two plates. The intermediate plate 4 is also bent cylindrically to match the shapes of the contact surfaces 14, 15.

The mode of operation of the binding support plate will be explained in the following with reference to the representation of FIG. 3. If the binding support plate 1 is loaded with a force couple $P_1$, $P_2$ when the ski runs on the edge at an angle $\alpha$, this causes the intermediate plate 4 to be elastically deformed and the bearing plate 3 to shift to the left into the position marked by the broken line. The magnitude of this shift and the deformation of the intermediate plate 4 are determined by the tension members 8 which absorb a considerable amount of the forces introduced and, through their radius of swivel, influence and limit the relative movement between the bearing plate 3 and the base plate 2. The lateral shift of the bearing plate 3 effects a displacement of force introduction via the shoe toward the running edge of the ski, resulting in consequence in an improved edge pressure and improved running characteristics in the manner initially described. The tension members 9 are fully relieved in this process and are compressed somewhat in an axial direction. This is however permitted readily by the flexibility of the material employed.

Figure 5:
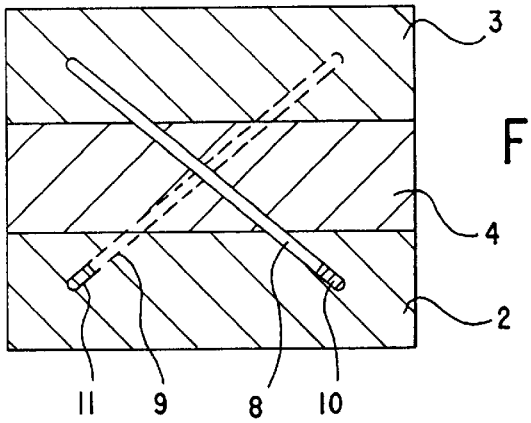
FIG. 5 is a cross sectional view of the binding support plate of FIG. 4, taken along the line V—V of that Figure.
Figure 4:
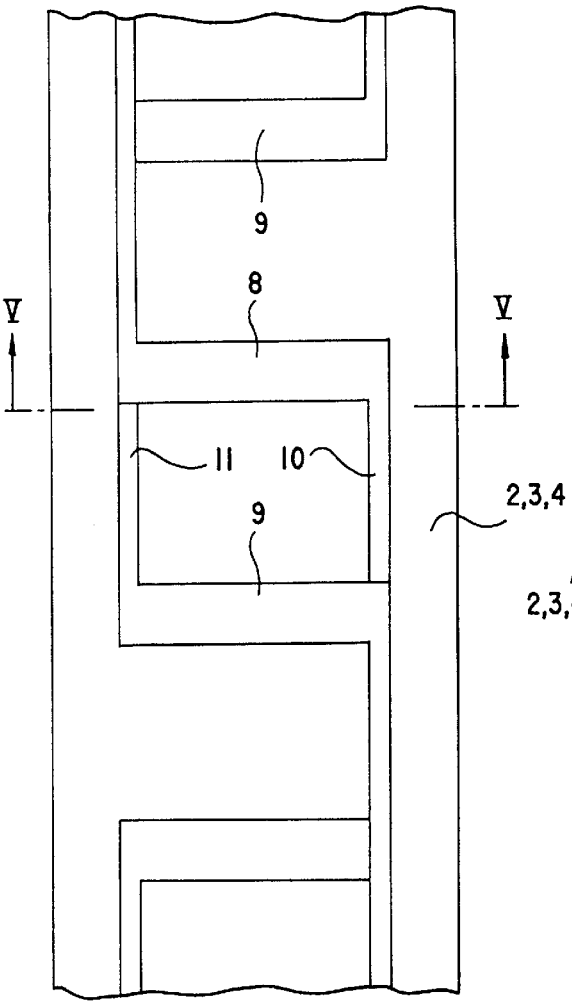
FIG. 4 is a top plan view, in a transparent representation, of a binding support plate having rectangular interconnected tension members.

The embodiment of the binding support plate 1 shown in FIGS. 4 and 5 corresponds in its basic construction and mode of operation with the embodiment of FIGS. 2 and 3. In this embodiment, the two groups of tension members 8, 9 are formed by pre-formed, braided or woven bands made of high-strength fibers or yarns which are interconnected in turn by connectors 10 to 13. The embodiment shows in addition that the contact surfaces 14, 15 can also be plane, whereby the shear load on the intermediate plate 4 during running on the edge is reduced and the compressive load is increased.

Figure 6:
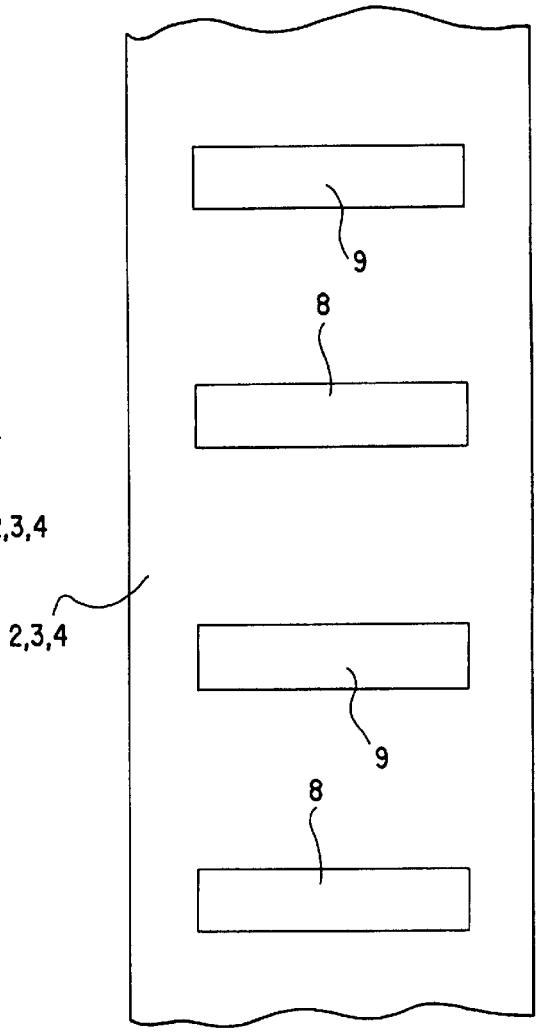
FIG. 6 is a transparent top plan view of a binding support plate having tension members comprised of individual strips.

FIG. 6 shows a variation of the binding support plate 1 in which the tension members 8, 9 are comprised of individual strips arranged in spaced relation to each other.

In the embodiments of FIGS. 2 to 6, the base plate 2, the intermediate plate 4 and the bearing plate 3 are manufactured by casting or injection molding. In this process, the tension members 8, 9 with their connectors 10 to 13 are each inserted in their intended position in the casting mold and the plate material is cast around them. This can be done, for example, by constructing the space to be filled by the intermediate plate 4 in the area between the base plate 2 and the bearing plate 3 as a wall of a casting mold for the production of the base plate 2 and the bearing plate 3, which wall is separable at the tension members 8, 9. After the latter two plates are cast it is then possible for this space to be filled with the elastomeric material of the intermediate plate.

Figure 7:
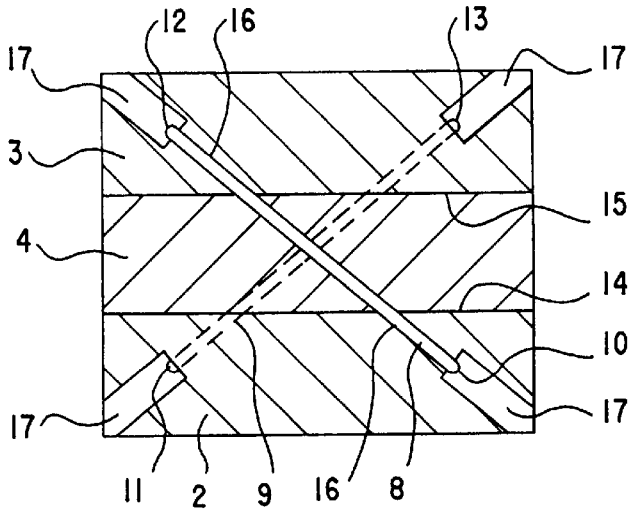
FIG. 7 is a cross sectional view of a binding support plate having tension members formed by a length of rope or wire pulled in from outside.

By contrast, the embodiment shown in FIG. 7 is intended for fitting the tension members 8, 9 subsequent to the manufacture of the base plate 2 and the bearing plate 3. For this purpose the base plate 2 and the bearing plate 3 have through bores 16 or slots through which the tension members 8, 9 can be pushed or pulled from the outside to the inside. On the one hand the tension members 8, 9 can thus be fitted before the space between the contact surfaces 14, 15 is filled with the elastomeric material of the intermediate plate 4. On the other hand it is also possible for the tension members 8, 9 to be fitted after the intermediate plate 4 is fitted between the base plate 2 and the bearing plate 3 by drilling through the elastomeric material of the intermediate plate 4 prior to fitting the tension members 8, 9 or piercing the material during the fitting. If the tension members 8, 9 are fitted after the intermediate plate 4 is fitted, it is possible to generate a defined bias in the intermediate plate 4 by suitable tensioning of the tension members 8, 9. To protect the fixing ends of the tension members 8, 9 and the connectors 10 to 13, longitudinal grooves 17 are provided on the outside of the base plate 2 and the bearing plate 3 into which the through bores 16 lead.

Figure 8:
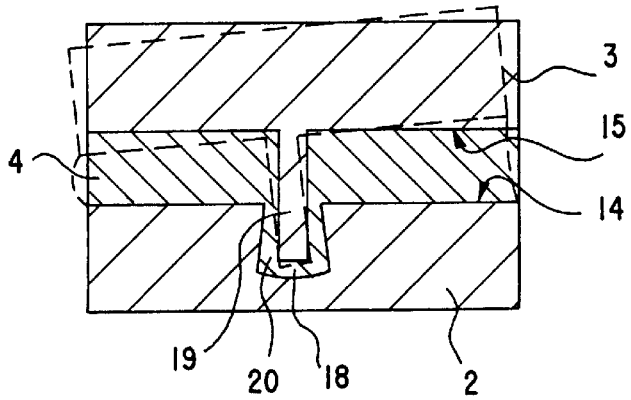
FIG. 8 is a cross sectional view of an embodiment of a binding support plate having an elastically mounted guide element in the form of a longitudinal rib.

In the embodiment of the binding support plate 1 shown in FIG. 8, the base plate 2 has a central longitudinal groove 18 in its contact surface 14, into which a rib 19 projecting from the contact surface 15 of the bearing plate 3 engages with its free end. Between the walls of the longitudinal groove 18 and the rib 19 is a clearance space 20 which is filled with the elastomeric material used for the intermediate plate 4. The result is an elastic joint which prevents parallel movement of the bearing plate 3 relative to the base plate 2 as well as turning of the bearing plate 3 relative to the base plate 2 around a vertical axis while at the same time permitting a lateral swiveling movement of the bearing plate 3 relative to the base plate 2 when the bearing plate 3 is loaded, as is the case when the ski runs on the edge, with a force inclined to the plane of the plate, and the intermediate plate 4 is compressed accordingly on one side. The broken line indicates this state of deformation which causes the position of the binding and shoe to be shifted relative to the ski in a manner improving the running characteristics.

Figure 9:
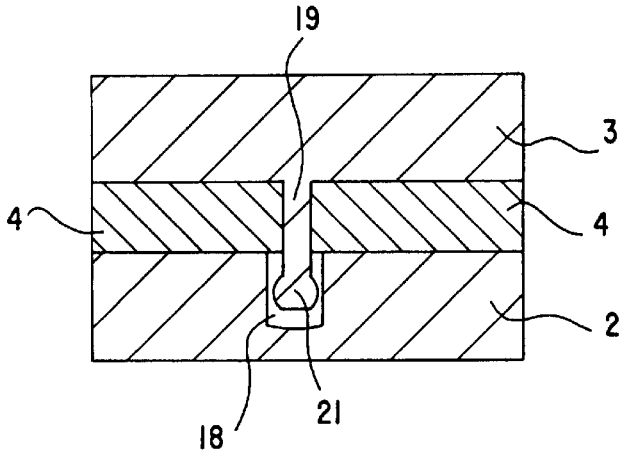
FIG. 9 is a cross sectional view of a binding support plate having a non-elastically mounted guide element in the form of a rib.

FIG. 9 shows a modification of the embodiment of FIG. 8 in which the joint is formed by a thick zone 21 in the form of a bead with cylindrical outer surfaces at the free end of the rib 19 and parallel wall surfaces of the longitudinal groove 18 which are engaged by the cylindrical outer surfaces. In this arrangement the intermediate plate 4 is comprised of two parts arranged on either side of the rib 19.

Figure 10:
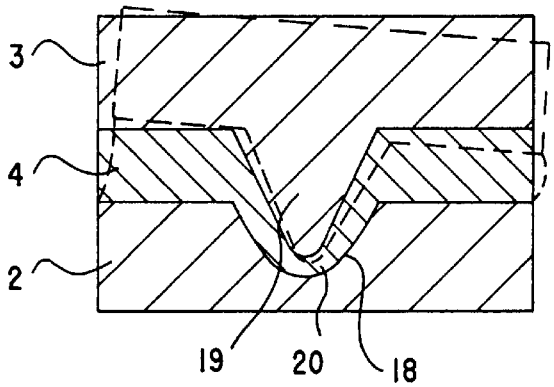
FIG. 10 is a cross sectional view of a binding support plate having a prism-shaped elastically mounted guide element.

In the embodiment shown in FIG. 10 the rib 19 takes the form of a triangular prism having a base surface in the plane of the contact surface 15 and which is integrally formed with the bearing plate 3. With its free end the prism engages in a V-shaped longitudinal groove 18 in the base plate 2, a clearance space 20 remaining between the prism and the walls of the groove, which space is filled, as in the embodiment of FIG. 8, with the same elastomeric material used for the intermediate plate 4. The advantage of this construction is that the bearing plate 3 is invested with a high level of rigidity by the prismatic shape of the rib 19, enabling the base plate 2 to be of softer construction in order to have less effect on the flexing behavior of the ski. The deformation behavior with the ski running on the edge is again illustrated by a broken line.

Figure 11:
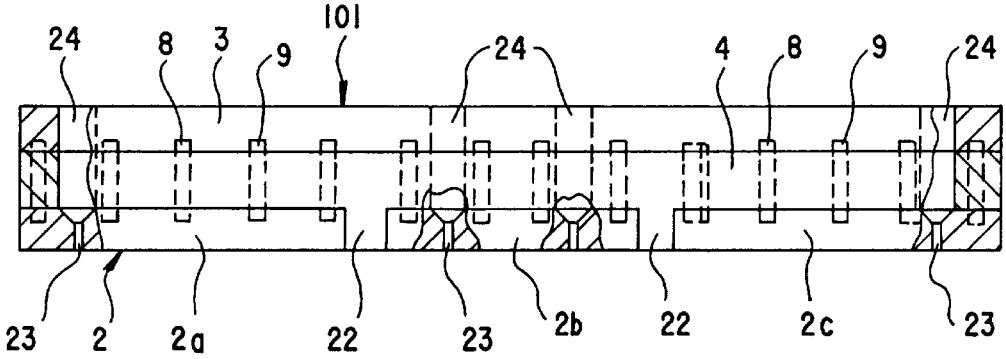
FIG. 11 is a side view of a binding support plate having a base plate comprised of three parts.

FIG. 11 shows a binding support plate 101 in which the base plate 2 is comprised of three plate parts 2*a*, 2*b*, 2*c* lying one behind the other, each separated from the other by a gap 22 filled with the same elastomeric material used for the intermediate plate 4. To fix the individual plate parts 2*a*, 2*b*, 2*c* to the ski fastening bores 23 are provided which are accessible from above through bores 24 in the bearing plate 3 and the intermediate plate 4. The plate parts 2*a*, 2*b*, 2*c* are connected to the bearing plate 3 and hence with each other by the intermediate plate 4 and by tension members 8, 9 in accordance with the embodiment of FIG. 6. By reason of this connection with the bearing plate 3 the plate parts 2*a*, 2*b*, 2*c* are movable relative to each other within limits, particularly in the longitudinal direction and in the flexing direction of the ski, the movements being compensated for by elastic deformations of the intermediate plate 4. The plate parts 2*a*, 2*b*, 2*c* are thus able to follow the respective deflection of the ski so that the ski's flexing behavior is practically unaffected by the binding support plate 101. The overall deformability of the intermediate plate 4 in the ski's longitudinal direction is so small, however, as to ensure the requisite positional stability of the support plate with the binding and the shoe.

What is claimed is:

1. A binding support plate of multiple element construction for a ski, having a base plate on the side close to the top side of the ski and securable thereto and a bearing plate which is arranged between the base plate and the binding or shoe sole and to which the binding can be secured, characterized in that an intermediate plate (4) made of an elastomeric material is arranged between the base plate (2) and the bearing plate (3), being elastically deformable by the forces occurring between the ski (6) and the shoe during skiing, and in that the bearing plate (3) is movable, by deformation of the intermediate plate (4), relative to the base plate (2) in a direction transverse to the longitudinal direction of the ski (6) and is adapted to take support on the base plate (2) by means of guide elements which limit the movement of the bearing plate (3) in a direction transverse to the longitudinal direction of the ski (6) to a variable degree dependent on the elastic deformation of the intermediate plate (4), wherein the guide elements comprise two groups of tension members (8, 9) which penetrate the intermediate plate (4) and have one of their ends anchored to the base plate (2) and their other end to the bearing plate (3), wherein, looking in longitudinal direction, the tension members (8, 9) of the one group connect the left-hand side of the base plate (2) with the right-hand side of the bearing plate (3) while the tension members (8, 9) of the other group connect the right-hand side of the base plate (2) with the left-hand side of the bearing plate (3).

2. The binding support plate as claimed in claim 1, characterized in that the base plate (2) is comprised of several relatively movable parts lying one behind the other in the longitudinal direction.

3. The binding support plate as claimed in claim 2, characterized in that the tension members (8, 9) are comprised of individual strips, bands or lamellae having their respective ends anchored in the base plate (2) and in the bearing plate (3), respectively.

4. The binding support plate as claimed in claim 2, characterized in that several tension members (8, 9) are comprised of a continuous length of band, strip, rope, wire or the like.

5. The binding support plate as claimed in claim 4, characterized in that the tension members (8, 9) are comprised of a braided, woven or twisted high-strength fiber material, for example, made of carbon fibers, glass fibers, plastic fibers or metal yarns.

6. The binding support plate as claimed in claim 2, characterized in that the ends of the tension members (8, 9) are integrally cast in the base plate (2) or the bearing plate (3).

7. The binding support plate as claimed in claim 2, characterized in that the ends of the tension members (8, 9) are embedded in respective grooves in the base plate (2) and bearing plate (3), which grooves are open on the side close to the intermediate plate (4), and that the ends of the tension members (8, 9) are fixed in place by filling the grooves with a suitable casting material such as the same material used for the intermediate plate (4).

8. The binding support plate as claimed in claim 2, characterized in that the base plate (2) and the bearing plate (3) have through bores (16) through which the tension members (8, 9) are passed, and the ends of the tension members (8, 9) projecting out of the bores are fixed to the respective plate.

9. The binding support plate as claimed in claim 8, characterized in that a length of band, strip, rope or wire for forming the tension members (8, 9) is passed along a meandering path through the through bores (16).

10. The binding support plate as claimed in claim 8, characterized in that longitudinal grooves (17) into which the through bores (16) lead are provided on the respective outsides of the base plate (2) and the bearing plate (3).

11. The binding support plate as claimed in claim 2, characterized in that the tension members (8, 9) are comprised of a rigid element and that the ends of the tension members (8, 9) are fastened so that only tensile loads are transmitted.

12. A binding support plate of multiple element construction for a ski, having a base plate on the side close to the top side of the ski and securable thereto and a bearing plate which is arranged between the base plate and the binding or shoe sole and to which the binding can be secured, characterized in that an intermediate plate (4) made of an elastomeric material is arranged between the base plate (2) and the bearing plate (3), being elastically deformable by the forces occurring between the ski (6) and the shoe during skiing, and in that the bearing plate (3) is movable, by deformation of the intermediate plate (4), relative to the base plate (2) in a direction transverse to the longitudinal direction of the ski (6) and is adapted to take support on the base plate (2) by means of guide elements which limit the movement of the bearing plate (3) in a direction transverse to the longitudinal direction of the ski (6) to a variable degree dependent on the elastic deformation of the intermediate plate (4), wherein an underside of the bearing plate (3) on a side close to the intermediate plate (4) is provided with a guide element formed by a pin, a rib (19) and rigidly connected to the bearing plate (3), said guide element projecting with a free end into a recess (18) in the base plate (2), in which it is movable vertically to the plane of the plate and adapted for swiveling motion around a center axis extending in the longitudinal direction of the plate.

13. The binding support plate as claimed in claim 12, characterized in that the free end of the guide element is provided with a thick zone with contact surfaces of ball, cylinder or blade shape supported with practically zero play on parallel side walls of the recess in the base plate (2).

14. The binding support plate as claimed in claim 12, characterized in that between the walls of the recess in the base plate (2) and the free end of the guide element there is a clearance space on all sides filled with an elastomeric material, particularly the same material used for the intermediate plate (4).

15. The binding support plate as claimed in claim 12 to 14, characterized in that the guide element has the shape of a cone or a triangular prism projecting with its point or edge into a mating recess in the base plate (2).

16. The binding support plate as claimed in claim 1, characterized in that the base plate (2) is equipped with fixed stops on which the bearing plate (3) or the guide element is adapted to take support.

17. The binding support plate as claimed in claim 1, characterized in that the individual plates of the binding support plate have a rectangular cross section.

18. The binding support plate as claimed in claim 1, characterized in that the contact surfaces on the base plate (2) and the bearing plate (3) on the side close to the intermediate plate (4) are curved around an axis extending in the longitudinal direction of the plates, with the contact surface of the base plate (2) being convex while the contact surface of the bearing plate (3) is concave.

* * * * *